US009668066B1

(12) United States Patent
Betts et al.

(10) Patent No.: US 9,668,066 B1
(45) Date of Patent: May 30, 2017

(54) BLIND SOURCE SEPARATION SYSTEMS

(71) Applicants: David Anthony Betts, Cambridge (GB); Mohammad A. Dmour, Cambridge (GB)

(72) Inventors: David Anthony Betts, Cambridge (GB); Mohammad A. Dmour, Cambridge (GB)

(73) Assignee: Cedar Audio Ltd. (GB)

( * ) Notice: Subject to any disclaimer, the term of this patent is extended or adjusted under 35 U.S.C. 154(b) by 0 days.

(21) Appl. No.: 14/746,262

(22) Filed: Jun. 22, 2015

Related U.S. Application Data

(63) Continuation of application No. 14/678,419, filed on Apr. 3, 2015, now abandoned.

(51) Int. Cl.

| | |
|---|---|
| ***G10L 21/02*** | (2013.01) |
| ***H04R 25/00*** | (2006.01) |
| *G10L 21/0272* | (2013.01) |
| *G10L 21/0216* | (2013.01) |

(52) U.S. Cl.
CPC ..... *H04R 25/40* (2013.01); *G10L 21/02* (2013.01); *G10L 21/0272* (2013.01); *G10L 2021/02166* (2013.01); *H04R 2225/43* (2013.01); *H04R 2430/20* (2013.01)

(58) Field of Classification Search
None
See application file for complete search history.

(56) References Cited

U.S. PATENT DOCUMENTS

| | | | | |
|---|---|---|---|---|
| 7,079,880 | B2 * | 7/2006 | Stetson | A61B 5/02416 600/310 |
| 7,383,178 | B2 * | 6/2008 | Visser | G10L 21/0272 704/227 |
| 8,285,773 | B2 * | 10/2012 | Cichocki | G06K 9/624 708/200 |
| 8,391,509 | B2 * | 3/2013 | Lee | H04R 3/007 381/56 |
| 8,498,863 | B2 * | 7/2013 | Wang | G10L 21/0272 704/200 |

(Continued)

OTHER PUBLICATIONS

Hiroshi Saruwatari et al. "Blind Source Separation Combining Independent Component Analysis and Beamforming", EURASIP Journal on Applied Signal Processing 2003:11, 1135-1146.*

(Continued)

*Primary Examiner* — Jialong He
(74) *Attorney, Agent, or Firm* — Tarolli, Sundheim, Covell & Tummino LLP

(57) ABSTRACT

We describe a method of blind source separation for use, for example, in a listening or hearing aid. The method processes input data from multiple microphones each receiving a mixed signal from multiple audio sources, performing independent component analysis (ICA) on the data in the time-frequency domain based on an estimation of a spectrogram of each acoustic source. The spectrograms of the sources are determined from non-negative matrix factorization (NMF) models of each source, the NMF model representing time-frequency variations in the output of an acoustic source in the time-frequency domain. The NMF and ICA models are jointly optimized, thus automatically resolving an inter-frequency permutation ambiguity.

20 Claims, 6 Drawing Sheets

(56) References Cited

U.S. PATENT DOCUMENTS

| | | | | |
|---|---|---|---|---|
| 8,805,697 | B2 * | 8/2014 | Visser | G10L 21/0272 381/23 |
| 2005/0222840 | A1 * | 10/2005 | Smaragdis | G10L 21/0272 704/204 |
| 2009/0234901 | A1 * | 9/2009 | Cichocki | G06K 9/624 708/320 |
| 2012/0294446 | A1 * | 11/2012 | Visser | H04S 1/007 381/17 |
| 2013/0294608 | A1 * | 11/2013 | Yoo | G10L 21/0272 381/56 |
| 2014/0133674 | A1 * | 5/2014 | Mitsufuji | H04R 3/00 381/92 |
| 2015/0086038 | A1 * | 3/2015 | Stein | G10L 21/0272 381/92 |

OTHER PUBLICATIONS

Choi, et al. "Blind Source Separation and Independent Component Analysis: A Review", Neural Information Processing, vol. 6, No. 1, Jan. 2005.*

Helen, Marko, and Tuomas Virtanen. "Separation of drums from polyphonic music using non-negative matrix factorization and support vector machine." Signal Processing Conference, 2005 13th European. IEEE, 2005.*

Hsieh, Hsin-Lung, and Jen-Tzung Chien. "A new nonnegative matrix factorization for independent component analysis." 2010 IEEE International Conference on Acoustics, Speech and Signal Processing. IEEE, 2010.*

* cited by examiner

BLIND SOURCE SEPARATION SYSTEMS

RELATED APPLICATIONS

This application is a continuation of U.S. patent application Ser. No. 14/678,419, filed 3 Apr. 2015, which is incorporated herein in its entirety.

FIELD OF THE INVENTION

This invention relates to methods, apparatus and computer program code for blind source separation, for example to assist listeners with hearing loss in distinguishing between multiple different simultaneous speakers.

BACKGROUND TO THE INVENTION

Many people's ability to understand speech is dramatically reduced in noisy environments such as restaurants and meeting rooms. This is especially true of the over 50s, and it is one of the first signs of age-related hearing loss, which severely curtails people's ability to interact in normal social situations. This can lead to a sense of isolation that has a profound influence on general lifestyle, and many studies suggest that it may contribute to dementia.

With this type of hearing loss, listeners do not necessarily suffer any degradation to their threshold of hearing; they could understand the speech perfectly well in the absence of the interfering noise. Consequently, many sufferers may be unaware that they have a hearing problem and conventional hearing aids are not very effective. Also, sufferers become more dependent on lip reading, so any technical solution should preferably have a low latency to keep lip sync.

Techniques are known for blind source separation, using independent component analysis (ICA) in combination with a microphone array. In broad terms such techniques effectively act as a beamformer, steering nulls towards unwanted sources. In more detail there in an assumption that the signal sources are statistically independent, and signal outputs are generated which are as independent as possible. The input signals are split into frequency bands and each frequency band is treated independently, and then the results at different frequencies are aligned. This may be done by assuming that when a source is producing power at one frequency it is probably also active at other frequencies. However this approach can suffer from problems if power at one frequency may be correlated with the absence of power at another frequency, for example the voiced and unvoiced parts of speech. This can lead to frequency bands from different sources being swapped in the output channels.

It is also known to employ non-negative matrix factorisation (NMF) to distinguish between speakers. In broad terms this works by learning a dictionary of spectra for each speaker. However whilst this can distinguish between characteristically different voices, such as male and female speakers, it has difficulty with finer distinctions. In addition this approach can introduce substantial latency into the processed signal, making it unsuitable for real time use and thus unsuitable, for example, to assist in listening to a conversation.

Accordingly there is a need for improved techniques for blind source separation. There is a further need for better techniques for assisting listeners with hearing loss.

SUMMARY OF THE INVENTION

According to the present invention there is therefore provided a method of blind source separation, the method comprising: inputting acoustic data from a plurality of acoustic sensors, said acoustic data comprising acoustic signals combined from a plurality of acoustic sources; converting said acoustic data to time-frequency domain data, wherein said time-frequency domain data is represented by an observation matrix $X_f$ for each of a plurality of frequencies f; performing an independent component analysis (ICA) on said observation matrix $X_f$ to determine a demixing matrix $W_f$ for each said frequency such that an estimate $Y_f$ of the acoustic signals from said source at said frequencies f is determined by $X_f W_f$; wherein said ICA is performed based on an estimation of a spectrogram of each said acoustic source; wherein said spectrogram of each said acoustic source is determined from a model of the corresponding acoustic source, the model representing time-frequency variations in a signal output of the acoustic source in the time-frequency domain.

In broad terms embodiments of the method employ a model that captures variations in both time and frequency (across multiple frequency bands), and then the independent component analysis effectively learns a decomposition which fits this model, for each source aiming to fit a spectrogram of the source. In this way the inter-frequency permutations of the demixing matrix are automatically resolved. Preferred embodiments of the model represent the behaviour of an acoustic source in statistical terms.

In principle the acoustic source model may be any representation which spans multiple frequencies (noting that the model may, for example, define that some frequencies have zero power). For example PCA (principle component analysis) or SVD (singular value decomposition) may be employed. However it is particularly advantageous to use an NMF model as this better corresponds to the physical process of adding together sounds. In principle a single component NMF model could be used, but preferably the NMF model has two or more components.

In preferred embodiments of the method the (NMF) model and independent component analysis (ICA) are jointly and iteratively improved. That is ICA is used to estimate the signals from the acoustic sources and then the (NMF) model is updated using these estimated signals to provide updated spectrograms, which are in turn used to once again update the ICA. In this way the ICA and NMF are co-optimised.

In some approaches the ICA and NMF models are updated alternately, but this is not essential—for example several updates may be performed to, say, the NMF model and then the ICA model may be updated, for example to more accurately align the permutations amongst frequency bands to sources. In practice, however, it has been found that interleaving updates of different types tends to approach the target joint optimisation faster, in part because the initial data tends to be noisy and thus does not benefit from an attempt to impose too much structure initially.

In some preferred implementations of the method the updating of the independent component analysis includes determining a permutation of elements of the demixing matrix over the acoustic sources prior to determining updated spectrograms ($\sigma_k$) for the acoustic sources. It is not essential to perform such a permutation but it can be helpful to avoid the method becoming trapped in local maxima. In broad terms the additional step of performing the permutation alignment based on the spectrogram helps to achieve a good fit of the NMF model more quickly (where frequency bands of different sources are cross-mixed the NMF model does not fit so well).

Preferably the updating of the ICA includes adjusting each of the demixing matrices $W_f$ according to a gradient ascent (or descent) method, where the gradient is dependent upon both the estimate of the acoustic signals from the sources and the estimate of the spectrograms of the sources (from the NMF model). In broad terms this gradient search procedure aims to identify demixing matrices which make the output data channels ($Y_f$) look independent given (i.e. in) the NMF model representation.

In embodiments the NMF model is defined by latent variables U (a frequency-dependent spectral dictionary for each source) and V (time-dependent dictionary activations) for each acoustic source (noting that U and V are tensors). The NMF model is updated by updating these latent variables. In embodiments this may be performed in two stages—identify the best dictionary given a set of activations; and identify the best set of activations given a dictionary. Preferably the dictionaries and activations are jointly optimised with the demixing matrix for each frequency although, as previously noted, the update steps need not be performed alternately.

In embodiments the NMF model factorises time-frequency dependent variances to a power $\lambda(\lambda\neq 2)$, $\sigma_k^{\lambda}$ rather than $\sigma_k^2$ because the ICA effectively performs a spatial rotation to decouple the signal components and with Gaussian data the squared power results in a circular cost contour which does not distinguish rotations. In some preferred embodiments $\lambda=1$ as this provides a good balance between some cost for rotation and avoiding being trapped in local maxima.

In broad terms embodiments of the method allocate audio sources to channels. However if too many channels are available the method may split a source over multiple channels, and fragmenting real sources in this way is undesirable. In embodiments, therefore, the method may preprocess the acoustic data to reduce an effective number of acoustic sensors to a target number of virtual sensors, in effect reducing the dimensionality of the data to match the actual number of sources. This may either be done based upon knowledge of the target number of sources or based on some heuristic or assumption about the number of likely sources. The reduction in the dimensionality of the data may be performed by discarding data from some of the acoustic sensors or, more preferably, may employ principal component analysis with the aim of retaining as much of the energy and shape of the original data as possible.

Preferably the method also compensates for a scaling ambiguity in the demixing matrices. In broad terms, whilst the independent component analysis may make the outputs of the procedure (source estimates) substantially independent, the individual frequency bands may be subject to an arbitrary scaling. This can be compensated for by establishing what a particular source would have sounded like at one or more of the acoustic sensors (or even at a virtual, reference acoustic sensor constructed from the original microphones). This may be performed by, for example, using one of the acoustic sensors (microphones) as a reference or, for a stereo output signal, using two reference microphones. The scaling ambiguity may be corrected by selecting time-frequency components for one of the output signals and by calculating the inverse of the estimated demixing matrix, since the combination of the demixing matrix and its inverse should reproduce what the source would have sounded like on (all the acoustic sensors). By employing this approach (eq(25) below) a user may determine what the selected source would have sounded like at each microphone. The user, or the procedure, may select a microphone to "listen to" (for example by selecting a row of the output data $Y_f(k)$ corresponding to source estimate k), or for stereo may select two of the microphones to listen to.

Embodiments of the method perform the blind source separation blockwise on successive blocks of time series acoustic data. However the labelling of sources k may change from one block to the next (for example if W, U, V are initialised randomly rather than based on a previous frame). It is therefore helpful to be able to identify which real source corresponds to which source label k in each block, to thereby partially or wholly remove a source permutation ambiguity. The skilled person will appreciate that a number of different techniques may be employed to achieve this. For example in some applications a desired target source may have a substantially defined or fixed spatial relationship to the acoustic sensors (microphone array), for example when it is desired to target speech output from a driver or passenger of a car. In another approach a loudest source (that is the direction from which there is most audio power) may be assumed to be the target source—for example where it is desired to distinguish between a speaker and background from an air conditioning unit in, say, a video conference setting. Alternatively characteristics of a source (for example from the NMF model) may be used to identify a target source.

In one preferred approach the system or a user may select a target direction for a target source to be selected. Then the procedure may identify the source which best matches this selected direction. This may be performed by, for example, selecting the source with the highest phase correlation between the microphone array phase response from the selected direction and the corresponding portion (row) of the set of demixing matrices.

The skilled person will appreciate that embodiments of the procedure directly produce source estimates (Y) or a selected source estimate (Y(k)), albeit in the time-frequency domain. Such a source estimate may be used in the time-frequency domain or may be converted back to the time domain. Alternatively, however, the demixing matrices W may be converted from the time-frequency domain to the time domain, for example using an inverse Fourier transform, to determine a time domain demixing filter.

The calculations to implement the above described blind source separation technique can be relatively time consuming (for example taking around 1 second on a current laptop), but it is desirable for embodiments of the method, in particular when used as a hearing aid, to be able to operate in substantially real time. To achieve this the procedure may be operated at intervals on sections of captured acoustic data to establish coefficients for a demixing filter, that is to determine the demixing matrices $W_f$. These coefficients may then be downloaded at intervals to a configurable filter operating in real time, in the time domain, on the acoustic data from the acoustic sensors.

In a related aspect, therefore, the invention provides apparatus to improve audibility of an audio signal by blind source separation, the apparatus comprising: a set of microphones to receive signals from a plurality of audio sources disposed around the microphones; and an audio signal processor coupled to said microphones, and configured to providing a demixed audio signal output; the audio signal processor comprising: at least one analog-to-digital converter to digitise signals from said microphone to provide digital time-domain signals; a time-to-frequency domain converter to convert said digital time domain signals to the time-frequency domain; a blind source separation module, to perform audio signal demixing in said time-frequency domain to determine a demixing matrix for at least one of said audio sources; and a digital filter to filter said digital time-domain signals in the time domain in accordance with filter coefficients determined by said demixing matrix, wherein said filter coefficients are determined asynchronously in said time-frequency domain; and wherein said audio signal processor is further configured to process said demixing matrix to select one or more said audio sources responsive to a phase correlation determined from said demixing matrix.

In embodiments the apparatus may be configured to resolve a scaling ambiguity in the demixing matrix as previously described and/or to reduce dimensionality of the input audio signal prior to demixing. Preferably the blind source separation module is configured to perform joint ICA and NMF processing to implement the audio signal demixing.

A demixed audio signal output, typically from an automatically or manually selected source, may be output and/or used in many ways according to the application. For example where the system is used as a listening aid the audio output may be provided to headphones, earbuds or the like, or to a conventional hearing aid. Alternatively the audio output may be provided to other electronic apparatus such as a video conferencing system or fixed line or mobile phone (for example, with an in-vehicle communications system).

The skilled person will appreciate that in the above described apparatus the audio signal processor may be implemented in hardware, firmware, software or a combination of these; on a dedicated digital signal processor, or on a general purpose computing system such as a laptop, tablet, smartphone or the like. Similarly the blind source separation module may comprise hardware (dedicated electronic circuitry), firmware/software, or a combination of the two.

In a further aspect the invention provides a method of blind source separation, the method comprising: processing an observation matrix $X_f$ representing observations of signals at a plurality of frequencies f from a plurality of acoustic sources using a demixing matrix $W_f$ for each of said frequencies to determine an estimate of demixed signals from said acoustic sources $Y_f$ for each of said frequencies, the processing comprising iteratively updating $Y_f$ from $X_f$ $W_f$; wherein said processing is performed based on a probability distribution $p(Y_{tkf}; \sigma_{tkf})$ for Y dependent upon $$\frac{1}{\sigma_{tkf}^2} e^{-\frac{|Y_{tkf}|^\lambda}{\sigma_{tkf}^\lambda}}$$

where t indexes time intervals and k indexes said acoustic sources or acoustic sensors sensing said acoustic sources; and wherein $\sigma_{tkf}$ are variances inferred from a non-negative matrix factorisation (NMF) model where $$\sigma_{tkf}^\lambda = \sum_l V_{ltk} U_{lfk}.$$

where l indexes non-negative components of said NMF model, U and V are latent variables of said NMF model, and $\lambda$ is a parameter greater than zero.

As previously described, in broad terms the NMF model imposes structure on the variances, noting that $\sigma_k$ is an approximation of the spectrogram of source k across frequencies, in particular because the dictionaries and activations defined by the latent variables U, V form a sparse representation of the data. In broad terms the NMF model (or potentially some other model) represents the spectrogram of source k as the time varying sum of a set of dictionary components. The ICA model expresses the probability of the source estimates given the variances imposed by the NMF model.

The signal processing determines a set of demixing matrices Wand values for the latent variables U, V which (preferably) optimally fit the above equations. Thus, as previously described, embodiments of the procedure iteratively update U, V and W, improving each tensor given the other two. Preferred implementations of the procedure also apply an optimal permutation to W, as this can in effect provide a relatively large step in improving Was compared with gradient ascent.

Thus in embodiments of the processing the following steps are applied, potentially more than once each, and potentially in any order: update W using permutation and/or scaling; update W using a gradient-based update; update U; update V. The updates of W may be used to determine updated source estimates (for updating U, V). The updates of U and V may be used to determine updated source spectrogram estimates (for updating W). Optionally U and V may be initialised based on prior information, for example a previously learnt, stored or downloaded dictionary.

The skilled person will appreciate that embodiments of the above described methods may be implemented locally, for example on a general purpose or dedicated computer or signal processor, phone, or other consumer computing device; or may be partly or wholly implemented remotely, in the cloud, for example using the communication facilities of a laptop, phone or the like.

The invention further provides processor control code to implement the above-described apparatus and methods, for example on a general purpose computer system or on a digital signal processor (DSP). The code is provided on a non-transitory physical data carrier such as a disk, CD- or DVD-ROM, programmed memory such as non-volatile memory (eg Flash) or read-only memory (Firmware). Code (and/or data) to implement embodiments of the invention may comprise source, object or executable code in a conventional programming language (interpreted or compiled) such as C, or assembly code, or code for a hardware description language. As the skilled person will appreciate such code and/or data may be distributed between a plurality of coupled components in communication with one another.

BRIEF DESCRIPTION OF THE DRAWINGS

These and other aspects of the invention will now be further described, by way of example only, with reference to the accompanying figures in which.

DETAILED DESCRIPTION OF PREFERRED EMBODIMENTS

Broadly speaking we will describe techniques for blind source separation on the audio outputs of a small microphone array to separate a desired source from one or more interfering sources. In one application a user can listen to the desired source in real time over headphones or via a hearing aid. However the technology is not just applicable to listening aids and can be useful in any application where a sensor array is measuring a linear convolutive mixture of sources. In audio this includes applications such as teleconferencing and machine hearing.

Figure 1:
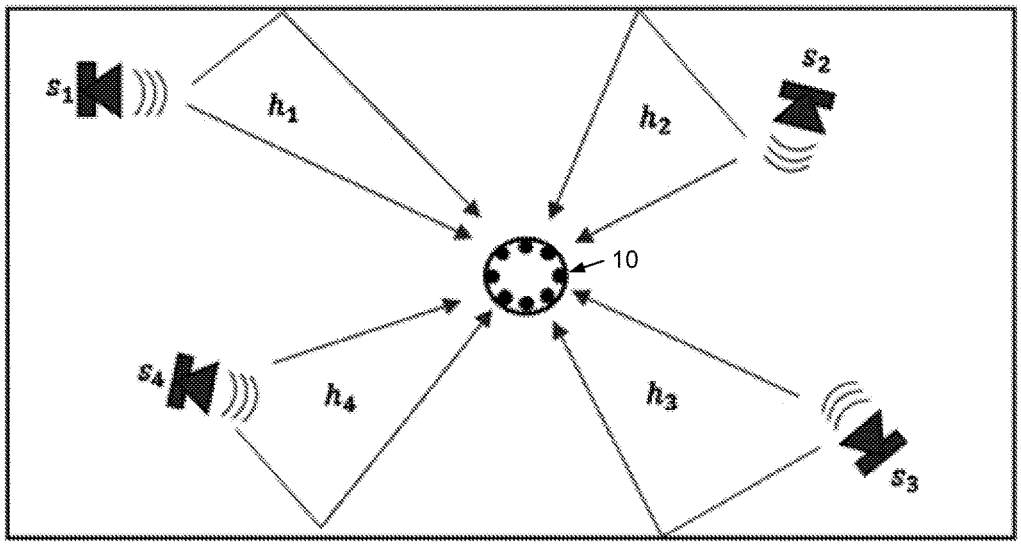
FIG. 1 shows an example acoustic environment to illustrate the operation of a system according to an embodiment of the invention.

By way of example, consider the acoustic scene of FIG. 1. This comprises four sources $s_1$-$s_4$ with respective audio channels $h_1$-$h_4$ to a microphone array 10 comprising (in this example) 8 microphones. The aim is to demix the microphone signals to make estimates of the original sources—that is to perform Blind Source Separation or Blind Signal Separation (BSS). We assume minimal information about the sources and the microphone locations. In some applications the microphone array may be placed on a table or chair in a social setting or meeting and embodiments of the systems we describe are used to separate a desired source, such as a person speaking, from undesired sounds such as other speakers and/or extraneous noise sources.

Using the multi-channel observations x, the task is to design a multi-channel linear filter w to create source estimates y.

$$\underline{y}_{t'} = \sum_{\tau} w_{\tau} \underline{x}_{t'-\tau} \tag{1}$$

Given the lack of location information, rather than recover the original sources the objective is to recover the sources up to a permutation ambiguity P and an arbitrary linear transformation $b_{k,\tau}$, $$y_{P(k),t} \approx \Sigma_{\tau} b_{k,\tau} s_{k,t-\tau} \tag{2}$$

where $s_k$ labels source k.

STFT Framework

Overlapped STFTs provide a mechanism for processing audio in the time-frequency domain. There are many ways of transforming time domain audio samples to and from the time-frequency domain. The NMF-ICA algorithm we describe can be applied inside any such framework; in embodiments we employ Short Time Fourier Transforms (STFT). Note that in multi-channel audio, the STFTs are applied to each channel separately.

Within this framework we define:

K is the number of channels.

F is the number of STFT frequencies.

T is the number of STFT frames.

In the STFT domain, the source estimate convolution eq(1) becomes matrix multiplication. At each frequency we have the T×K observation matrix $X_f$, and an unknown demixing matrix $W_f$ such that the demixed output $Y_f$ is given by $$Y_f = X_f W_f \tag{3}$$

Here the demixed output $Y_f$ is also a T×K matrix where k labels sources, and the demixing matrix $W_f$ is a K×K matrix ($X \in \mathbb{C}_{T\times K\times F}$, $Y \in \mathbb{C}_{T\times K\times F}$, $W \in \mathbb{C}_{K\times K}$).

The equivalent objective to eq(2) is $$Y_f \approx S_f B_f P \tag{4}$$

where $B_f$ is an arbitrary diagonal scaling matrix, and P is a global permutation matrix. The task of Blind Source Separation is to use knowledge of the statistics of audio to estimate $W_f$ for each frequency.

Notation

- $\triangleq$ means equal up to a constant offset (which can be ignored).
- $\Sigma_{a,b}$ means summation over both indices a and b; equivalent to $\Sigma_a \Sigma_b$
- We use lower case subscripts to indicate an element of a tensor e.g. $u_{tkf}$
- We denote sub tensors by dropping the appropriate subscript e.g. $u_{tk}$ denotes the vector formed over f from $u_{tkf}$.

ML-ICA

To provide some context we first outline Maximum Likelihood independent component analysis (ML-ICA): If we assume that the demixed output Y is drawn from a complex circular symmetric (CCS) Laplace distribution then we obtain $$\rho(Y_{tkf}) \propto e^{-|Y_{tkf}|}$$

Real audio signals tend to be heavy-tailed. The Laplace distribution is the most heavy-tailed distribution that retains the useful convergence property of being log-concave. Assuming independence, the log-likelihood of the observations $X_f$ given the matrix $W_f$ is then given by:

$$L(X_f; W_f) \triangleq 2T \ln|\det W_f| + \sum_{t,k} L(Y_{tkf}) \tag{5}$$

where $L(Y_{tkf}) \triangleq -|Y_{tkf}|$.

For each frequency f, ML-ICA searches over $W_f$ for a local maximum to eq(5). The result is an estimate for the sources up to a scaling ambiguity ($B_f$) and an inter-frequency permutation ($P_f$):

$$Y_f \approx S_f B_f P_f$$

ML-ICA then uses a separate permutation alignment operation to determine the inter-frequency permutations. One permutation alignment mechanism is to maximise the cross correlation of the output across frequencies according to some distance criterion. However one problem with this approach is that the fricatives and voiced parts of speech are normally anti-correlated, and this can lead to them being swapped between output channels.

NMF-ICA

Non-negative matrix factorisation (NMF) is a technique that can provide a good model for the structure inherent in real audio signals. The techniques we describe here combine NMF and ICA into a single unified approach where they can be jointly optimised.

We make the premise that the STFT time-frequency data is drawn from a statistical NMF-ICA model with unknown latent variables (which include the demixing matrices $W_f$). The NMF-ICA algorithm then has four basic steps.

Use the STFT to convert the time domain data into a time-frequency representation.

Use statistical inference to calculate either the maximum likelihood or the maximum posterior values for the latent variables. The algorithms work by iteratively improving an estimate for the latent variables.

Given estimates for the latent variables, the procedure can directly calculate the source estimates Y from eq(3).

Depending on the application the procedure can then either:

use the inverse STFT to convert the estimate of Y back into the time domain; or use a multi-channel inverse Fourier Transform on W to calculate the demixing time domain filter.

Maximum Likelihood NMF-ICA Model

In deriving the NMF-ICA model we first express the probability of Y in terms of a generalisation of a complex normal distribution with unknown time-frequency dependent variance σ and:

$$p(Y_{tkf};\sigma_{tkf}) \propto \frac{1}{\sigma_{tkf}^2} e^{-\frac{|Y_{tkf}|^\lambda}{\sigma_{tkf}^\lambda}}. \tag{6}$$

The variances $\sigma_{tkf}$ are then inferred from an NMF model with L non-negative components defined by the latent variables U, V (a set of dictionaries and activations for each source) such that $$\sigma_{tkf}^\lambda = \sum_l V_{ltk} U_{lfk}. \tag{7}$$

We factorise $\sigma_{tkf}^\lambda$ as it gives analytically tractable update equations. Assuming independence, we can write the overall log likelihood of the observations given the model parameters as:

$$L(Y_{tkf};\sigma_{tkf}) \triangleq -\frac{2}{\lambda}\ln(\sigma_{tkf}^\lambda) - \frac{|Y_{tkf}|^\lambda}{\sigma_{tkf}^\lambda} \tag{8}$$

$$L(X;W,U,V) \triangleq \sum_f 2T\ln|\det W_f| + \sum_{t,k,f} L(Y_{tkf};\sigma_{tkf}) \tag{9}$$

The task is then to search over W, U, V for the maximum likelihood (ML) solution to equation (9). (The factors of 2 in eq. (8) and (9) are due to using complex circular symmetric distributions, although the NMF-ICA algorithm is robust to using a different factor).

This NMF-ICA model then has several advantages over ML-ICA:

It unifies permutation alignment and ICA.

Taking λ<1 will create a more heavy-tailed distribution at the expense of potentially introducing more local maxima.

Having several components allows uncorrelated and anti-correlated behaviour such as fricatives vs voiced behaviour to be modelled.

The latent variables U, V provide a wider solution space which will generally contain better solutions than ML-ICA Related Models: Maximum a Posteriori Model One can introduce prior information about the latent variables using Bayes rule. Embodiments of this procedure use inverse gamma priors for U and V as they again lead to analytically tractable solutions.

$$L(V_{ltk};\gamma,\alpha) \triangleq -(\alpha+1)\ln V_{ltk} - \frac{\gamma}{V_{ltk}}$$

$$L(U_{lfk};\gamma',\alpha') \triangleq -(\alpha'+1)\ln U_{lfk} - \frac{\gamma'}{U_{lfk}}$$

$$L(V;\gamma,\alpha) = \sum_{l,t,k} L(V_{ltk};\gamma,\alpha)$$

$$L(U;\gamma',\alpha') = \sum_{l,f,k} L(U_{lfk};\gamma',\alpha')$$

Note that a side effect of the priors is to resolve the scaling ambiguity in the NMF model between U and V. This ambiguity does not matter from a theoretical point of view, but it can potentially cause numerical instability in practice.

Combining the priors with the observation likelihoods eq(9) using Bayes rule gives a posterior likelihood of $$L(W,U,V;X,\ldots) \triangleq L(X;W,\sigma,\lambda)+L(V;\gamma,\alpha)+L(U;\gamma',\alpha'). \tag{10}$$

Maximising this equation gives maximum a posteriori (MAP) solution to the problem.

Fixed Dictionary

Rather than learning U blindly from the data, embodiments of the procedure can use a fixed set of dictionaries, learnt from some representative single source training data. The scaling ambiguities between U, V and W mean that some of the variability that would have been captured by optimising U can be absorbed in the updates of V and W. A fixed dictionary can be a computational saving.

Input Channel Noise

Embodiments of the procedure can model stationary input channel noise by including an extra noise term in eq(7). This component has activations set to 1 and a fixed spectral dictionary.

Optimisation

The maximum a posteriori estimation (MAP) is found by maximising eq. (10). Similarly the maximum likelihood estimator (ML) is found by maximising eq. (9). Both these procedures are very similar, so we will derive the MAP estimator first.

We iteratively optimise L(W, U, V; X, . . . ) with respect to U, V and W. To optimise with respect to U and V we use a minorisation-maximisation (MM) algorithm. We optimise W using two different algorithms; the first optimises W with respect to permutations and output gain, the second uses a natural gradient method. All of these methods apart from the natural gradient give guaranteed convergence to a local maximum. The natural gradient method is expected to converge for a suitably small step size.

Optimisation with Respect to U

Looking at the terms in eq(10) that depend upon U one obtains:

$$L(W,U,V;X,\ldots) \triangleq -\sum_{t,k,f}\left(\frac{2}{\lambda}\ln(\sigma_{tkf}^\lambda) + \frac{|Y_{tkf}|^\lambda}{\sigma_{tkf}^\lambda}\right) - \sum_{l,f,k}\left((\alpha'+1)\ln U_{lfk} + \frac{\gamma'}{U_{lfk}}\right) \tag{11}$$

If we take a hypothetical function $f(x)$, the first stage of MM is minorisation, which is creating an auxiliary function $f^+(\hat{x},x)$, that satisfies $$f^+(\hat{x},x) \le f(\hat{x})$$

$$f^+(x,x)=f(x)$$

The auxiliary function should be one that is easier to maximise than the original. The second stage is then maximising $f^+(\hat{x},x)$ with respect to $\hat{x}$. Because of the constraints we know that $f(\hat{x}) \ge f^+(\hat{x},x) \ge f(x)$, which proves that iterating the process will converge on a maximum of $f$. One important property is that the sum of functions can be minorised by the sum of the individual minorisations.

In our case we have four terms. Two of the terms involve $-\ln x$ which is convex and can be minorised by simple linearisation about the current point $$f(x) = -\ln x$$

$$f^+(\hat{x}, x) = -\left(\ln x + \frac{\hat{x}}{x} - 1\right)$$

The second term is $$-\frac{1}{\sum_l U_{lfk} V_{ltk}}.$$

A suitable minorisation for this is:

$$\sigma^{\lambda}_{ftk} = \sum_l V_{ltk} U_{lfk}$$

$$f(U) = -\frac{1}{\sigma^{\lambda}_{ftk}}$$

$$f^+(\hat{U}, U) = -\frac{1}{(\sigma^{\lambda}_{ftk})^2} \sum_l \frac{U^2_{lfk} V_{ltk}}{\hat{U}_{lfk}}$$

Lastly we have terms of the form $-1/x$. These don't require minorising so we define $$f(x) = -\frac{1}{x}$$

$$f^+(\hat{x}, x) = -\frac{1}{\hat{x}}$$

Putting these together gives a minorisation for eq(10) as:

$$\mathfrak{L}^+(\hat{U}, U) = -\sum_{t,k,f} \frac{2}{\lambda}\left(\ln(\sigma^{\lambda}_{tkf}) + \frac{\sum_l \hat{U}_{lfk} V_{ltk}}{\sigma^{\lambda}_{tkf}} - 1\right) + \frac{|Y_{tkf}|^{\lambda}}{\sigma^{\lambda}_{tkf}} \sum_l \frac{U^2_{lfk} V_{ltk}}{\hat{U}_{lfk}} - \sum_{l,f,k} (\alpha' + 1)\left(\ln U_{lfk} + \frac{\hat{U}_{lfk}}{U_{lfk}} - 1\right) + \frac{\gamma'}{\hat{U}_{lfk}}$$

This auxiliary function only has a single maximum, which can be found analytically. Solving for $\hat{U}$ gives:

$$\frac{\partial \mathfrak{L}^+}{\partial \hat{U}_{lfk}} = -\frac{\alpha' + 1}{U_{lfk}} + \frac{\gamma'}{\hat{U}^2_{lfk}} - \sum_t \left(\frac{2}{\lambda} V_{ltk} \hat{\sigma}^{-\lambda}_{tkf} - \frac{|Y_{tkf}|^{\lambda}}{\sigma^{2\lambda}_{ftk}} \frac{U^2_{lfk} V_{ltk}}{\hat{U}^2_{lfk}}\right) \tag{12}$$

$$\hat{U}_{lfk} = \sqrt{\frac{\gamma' + U^2_{lfk} \sum_t V_{ltk} |Y_{tkf}|^{\lambda} \sigma^{-2\lambda}_{tkf}}{\frac{\alpha' + 1}{U_{lfk}} + \frac{2}{\lambda} \sum_t V_{ltk} \sigma^{-\lambda}_{tkf}}}$$

Importantly this update is guaranteed to improve the likelihood eq(10), so it can be interleaved with the other stages of the NMF-ICA algorithm. Having calculated $\hat{U}_{lfk}$ for all l, f, k, we can then update U by assigning $U_{lfk} \leftarrow \hat{U}_{lfk}$.

Optimisation with Respect to V

Optimising with respect to V follows the same process as for U. By symmetry we obtain:

$$\hat{V}_{ltk} = \sqrt{\frac{\gamma + V^2_{ltk} \sum_f U_{lfk} |Y_{tkf}|^{\lambda} \sigma^{-2\lambda}_{tkf}}{\frac{\alpha' + 1}{V_{ltk}} + \frac{2}{\lambda} \sum_f U_{lfk} \sigma^{-\lambda}_{tkf}}} \tag{13}$$

Having calculated $\hat{V}_{ltk}$ for all l, t, k, we can then update V by assigning $V_{ltk} \leftarrow \hat{V}_{ltk}$.

Rank 1 Solution to U and V

When L=1 it is possible to solve $$\frac{\partial L}{\partial V_{tk}} = 0$$

directly without minorisation-minimisation. (Note that we can drop the l subscript). The solution is given by $$\hat{V}_{tk} = \frac{\gamma + \sum_f \frac{|Y_{tkf}|^{\lambda}}{U_{fk}}}{\alpha + 1 + \frac{2F}{\lambda}} \tag{14}$$

Similarly the solution for $$\frac{\partial L}{\partial U_{fk}} = 0$$

is $$\hat{U}_{fk} = \frac{\gamma' + E_t \frac{|Y_{tkf}|^{\lambda}}{V_{tk}}}{\alpha' + 1 + \frac{2T}{\lambda}} \tag{15}$$

The rank-1 solution for $U_{fk}$ is redundant as, without any loss of generality, it can be absorbed into the scaling values $\Lambda_{kkf}$ (described later).

Optimisation with Respect to W

In optimising W we introduce the following matrix notation:

$\sigma_f$ is the appropriate T×K matrix (T-rows; K-columns) formed from $\sigma_{tkf}$.

Tr A is the trace of matrix A.

I is the identity matrix

Element wise operations are indicated by • as follows:

A•B is element wise (Hadamard) multiplication, ln•A take the natural logarithm the elements of A, $A^{\bullet\lambda}$ raises the elements of A to the power λ, $abs^{\bullet}$ A takes the absolute values of the elements of A.

Optimising W is independent of the priors on U and V, so we can rewrite both the MAP and ML likelihood equations as functions of W, σ plus a constant offset as $$L(W_f;\sigma^{\bullet\lambda},\ldots)\triangleq T\ln det(W_f^H W_f)-Tr((\sigma_f^{\bullet\lambda})^T abs^{\bullet}Y_f^{\bullet\lambda}) \tag{16}$$

It is also useful to define an intermediate variable $$Q_f=\frac{\lambda}{2T}(\sigma_f^{\bullet-\lambda})^T\mathrm{abs}\cdot Y_f^{\bullet\lambda}$$

Permutation and Scaling

The likelihood equation (16) can be directly optimised with respect to permutations and scaling. Let $P_f$ be a permutation matrix and $\Lambda_f$ be a diagonal real scaling matrix. The updated value of $W_f$ will be given by $$W_f\leftarrow W_f P_f\Lambda_f. \tag{17}$$

Note that for permutation and scaling we have $$|detP_f|=1$$

$$abs^{\bullet}(Y_f P_f\Lambda_f)^{\bullet\lambda}=(abs^{\bullet}Y_f^{\bullet\lambda})P_f\Lambda_f^{\lambda}.$$

Treating the likelihood as a function of $P_f$ and $\Lambda_f$ we get $$L(W_f P_f\Lambda_f;\sigma_f^{\bullet\lambda},\ldots)\triangleq\frac{2T}{\lambda}(\ln\det\Lambda_f^{\lambda}-Tr(Q_f P_f\Lambda_f^{\lambda})). \tag{18}$$

For each f we can now maximise L with respect to $\Lambda_f$ given $P_f$ to show that $$\Lambda_{kkf}=(Q_f P_f)_{kk}^{-1/\lambda} \tag{19}$$

If we substitute eq(19) back into the eq(18) we can solve for $P_f$ by $$P_f\leftarrow\leftarrow Tr(P_f\ln^{\bullet}Q_f) \tag{20}$$

To update $W_f$ we therefore calculate $Q_f$ as defined above, then apply equation (20), equation (19) and finally equation (17).

Using this permutation and scaling stage can alleviate the local maxima problem and allows the procedure to use λ<1, as it can jump the solution between local maxima.

Natural Gradient

Eq. (16) can be differentiated with respect to W using Wirtinger calculus to give $$\nabla L_f=2T\cdot W_f^{-H}-\lambda((\sigma_f^{\bullet-\lambda}\bullet abs^{\bullet}Y_f^{\bullet\lambda}\bullet Y_f^{\bullet-1})^T X_f)^H \tag{21}$$

The natural gradient $\partial W_f$ is the direction of steepest ascent of L with respect to distance ds travelled in a Riemannian manifold. The manifold for invertible matrices gives us $$ds^2=\|W_f^{-1}\partial W_f\|_F^2$$

$$\partial W_f=W_f W_f^H\nabla L_f. \tag{22}$$

Using an intermediate variable $\Psi_f$ and a step size μ we can substitute eq(21) into eq(22) to get an update equation $$\Psi_f=\frac{\lambda}{2T}(\sigma_f^{\bullet-\lambda}\cdot\mathrm{abs}\cdot Y_f^{\bullet\lambda}\cdot Y_f^{\bullet-1})^T Y_f \tag{23}$$

$$\partial W_f=W_f(I-\Psi_f^H)$$

$$W_f\leftarrow W_f+\mu\partial w_f \tag{24}$$

In the above update equations the superscript T refers to transpose, and the variable T to the number of frames. The calculation of $\Psi_f$ is deterministic, from $Y_f$ and $\sigma_f$; the step size μ can be a fixed value such as 0.1.

Diagonal Scaled Natural Gradient

The procedure can skip the permutation but still perform the scaling efficiently as part of the natural gradient. Where the procedure skips the permutation we have $P_f$=I. Since $Q_{kkf}=\Psi_{kkf}$ (i.e. the diagonal elements of $Q_f$ and $\Psi_f$ are the same), we can calculate the diagonal scaling $\Lambda_f$ in eq(19) directly from $\Psi_f$. The scaling can then be incorporated into the update by making the following substitutions in eq(23) and eq(24):

$$\Lambda_{kkf}\leftarrow\Psi_{kkf}^{-\frac{1}{\lambda}}$$

$$\Psi_f\leftarrow\Lambda_f\Psi_f^H\Lambda_f^{\lambda-1}$$

$$W_f\leftarrow W_f\Lambda_f$$

Overall Blind Source Separation Algorithm

A preferred embodiment of the overall algorithm recursively uses each of the above optimisation steps to improve the estimates of W, U, V. An example implementation is set out below, noting that the initialisation can change, and that in principle the update steps 2(a,b), 2(c,d), 2(e,f), 2(g,h) may be performed in any order:

1. Initialise W, U, V for example as follows:
   a. $W_f$=I for all f.
   b. U is randomly initialised with non-negative real values.
   c. V is randomly initialised with non-negative real values.
   d. $Y_f\leftarrow X_f$ for all f.
   e. $\sigma_k^{\bullet\lambda}\leftarrow V_k^T U_k$ for all k.
2. Repeat until convergence:
   a. Update W using the permutation and scaling eq(17) for all f.
   b. $Y_f\leftarrow X_f W_f$ for all f.
   c. Update W using the natural gradient eq(24) for all f.
   d. $Y_f\leftarrow X_f W_f$ for all f.
   e. Update U using minorisation-maximisation eq(12).
   f. $\sigma_k^{\bullet\lambda}\leftarrow V_k^T U_k$ for all k.
   g. Update V using minorisation-maximisation eq(13).
   h. $\sigma_k^{\bullet\lambda}\leftarrow V_k^T U_k$ for all k.

The convergence criterion can be a fixed number of iterations (say 25 to 30), or until there has been no significant change in W, U or V.

A preferred embodiment of employs random initialisation of U and V so that each component is initialised with a different profile. Alternatively initialisations from priors or from the data may be employed.

In broad terms, embodiments of the procedure aim to maximise eq(9) with respect to W, U and V, or eq(10) if there are priors on U, V.

Maximum Likelihood Variant

The maximum likelihood criterion is essentially the same as the MAP estimator, but without the priors on U or V. Thus in embodiments the only effect is a minor change to the updates on U and V. The update on U, eq(12), becomes:

$$\hat{U}_{lfk} = U_{lfk}\sqrt{\frac{\sum_t V_{ltk}|Y_{tkf}|^{\lambda}\sigma_{tkf}^{-2\lambda}}{\frac{2}{\lambda}\sum_t V_{ltk}\sigma_{tkf}^{-\lambda}}}$$

Similarly eq(13) becomes:

$$\hat{V}_{ltk} = V_{ltk}\sqrt{\frac{\sum_t U_{lfk}|Y_{tkf}|^{\lambda}\sigma_{tkf}^{-2\lambda}}{\frac{2}{\lambda}\sum_f U_{lfk}\sigma_{tkf}^{-\lambda}}}$$

There are also maximum likelihood equivalents to the rank-1 equations.

Extensions

The above described procedure performs NMF-ICA blind source separation.

However extensions are desirable for practical application of the techniques to listening aids and in other fields.

Dimension Reduction

Embodiments of the above described procedure demix the signals from K audio channels (microphones) into signals from K putative sources. However where the number of sources (eg 2) is less than the number of microphones (eg 8), sources can be fragmented—one real source can be split across two or more presumed sources. For this reason it can be beneficial to reduce the dimensionality of the input data (number of input channels) to match the actual number of sources.

Thus where the number of sources is less than the number of microphones the procedure can use dimension reduction to reduce the problem to a smaller number of virtual microphones. The microphone observations $X_f$ are pre-processed by a multichannel linear filter $W_{DR_f}$ which has fewer columns than rows:

$$X_f' = X_f W_{DR_f}$$

It is these virtual microphone signals $X_f'$ which are then passed to the NMF-ICA algorithm. For example, if $K_R$ is the reduced number of channels, then $W_{DR_f}$ is a K by $K_R$ matrix, $X_f$ is a T by K matrix, and $X_f'$ is a T by $K_R$ matrix.

The simplest form of dimension reduction is to discard microphones, but Principal Component Analysis gives a minimum distortion dimension reduction. It is found by setting $W_{DR_f}$ to the set of eigenvectors corresponding to the largest eigenvalues of $X_f^H X_f$.

Scaling Ambiguity

Embodiments of the above described procedure extract the source estimates up to an arbitrary diagonal scaling matrix $B_f$. This is an arbitrary filter, since there is a value of $B_f$ at each frequency (this can be appreciated from the consideration that changing the bass or treble would not affect the independence of the sources). There is an unknown filter arising from the transfer function of the room, but the arbitrary filter can be removed by considering what a source would have sounded like at a particular microphone.

In one approach the scaling ambiguity can be resolved by taking one source, undoing the effect of the demixing to see what it would have sounded like at one or more of the microphones, and then using the result to adjust the scaling of the demixing matrix to match what was actually received (heard)—that is, applying a minimum distortion principle. This correction can be subsumed into a modified demixing matrix.

The procedure can estimate the sources as received at the microphones using a minimum distortion principle as follows:

- Let $\hat{W}_f$ be the combined demixing filter including any dimension reduction or other pre processing e.g. $\hat{W}_f = W_{DR_f} W_f$.
- Let $\hat{W}_f^{\dagger}$ be the pseudo inverse of $\hat{W}_f$. This is a minimum distortion projection from the source estimates back to the microphones.
- Let D(k) be a selector matrix which is zero everywhere except for one element on the diagonal $D(k)_{kk}=1$.

To project source estimate k back to all the microphones we use $$W_f'(k) = \hat{W}_f D(k) \hat{W}_f^{\dagger} \quad (25)$$

$$\hat{Y}_f(k) = X_f W_f'(k) \quad (26)$$

Matrix D(k) selects one source k, and equations (25) and (26) define an estimate for the selected source on all the microphones. In equation (26) $\hat{Y}_f$ (k) is an estimate of how the selected source would have sounded at microphones, rather than an estimate of the source itself, because the (unknown) room transfer function is still present.

Source Selection

Oftentimes it is only a subset of the sources that is desired. Because there is still a global permutation, it may be useful to estimate which of the sources are the desired ones—that is, the sources have been separated into independent components but there is still ambiguity as to which source is which (eg in the case of a group of speakers around a microphone, which source k is which speaker). In addition embodiments of the procedure operate on time slices of the audio (successive groups of STFT frames) and it is not guaranteed that the "physical" source labelled as, say, k=1 in one group of frames will be the same "physical" source as the source labelled as k=1 in the next group of frames (this depends upon the initialisation of U, V, and W, which may, for example, be random or based on a previous group of frames).

Source selection may be made in various ways, for example on the basis of voice (or other audio) identification, or matching a user selected direction. Other procedures for selecting a source include selecting the loudest source (which may comprise selecting a direction from which there is most power); and selecting based upon a fixed (predetermined) direction for the application. For example the wanted source may be a speaker with a known direction with respect to the microphones. A still further approach is to look for a filter selecting a particular acoustic source which is similar to a filter in an adjacent time-frequency block, assuming that similar filters correspond to the same source. Such approaches enable a consistent global permutation matrix (P) to be determined from one time-frequency block to another.

In embodiments to match a user-selected direction knowledge of the expected microphone phase response $\theta_{jf}$ from the indicated direction may be employed. This can either be measured or derived from a simple anechoic model given the microphone geometry relative to an arbitrary origin. A simple model of the response of microphone j may be constructed as follows:

Given the known geometry for each microphone we can define s is the speed of sound.

$\underline{x}_j$ is the position of microphone j relative to an arbitrary origin in real space $\underline{d}$ is a unit vector corresponding to a chosen direction towards the desired source in the same coordinate system as $\underline{x}_j$.

ρ is the sample rate (of digitised samples from the microphone).

The far field microphone time delay, $\tau_j$, in samples relative to the origin is then given by $$\tau_j = -\frac{\rho \underline{x}_j^T \underline{d}}{s}$$

This leads to a phase shift for microphone j of $$\theta_{jf} = e^{2\pi\tau_j \frac{f}{F} i}$$

However the phase response $\theta_{jf}$ is determined, the chosen source $k_s$ is the source whose corresponding row in $\hat{W}_f$[554] maximises the phase correlation:

$$k_s = \arg\max_k \sum_f \left| \sum_j \frac{\hat{W}_{kjf}^{\dagger}}{|\hat{W}_{kjf}^{\dagger}|} \theta_{jf}^{*} \right|^2$$

where the sum j runs over the microphones and $\theta_{jf}$ is the (complex) frequency/phase response of microphone j in the selected direction. In principle this approach could be employed to select multiple source directions.

Low Latency Implementation

In embodiments of the above described procedure the output of the procedure may be $Y_f$ or $\hat{Y}_f$ (k); additionally or alternatively an output may be the demixing filter $W_f$ or $W_f'(k)$. Where the output comprises a demixing filter this may be provided in the time-frequency domain or converted back into the time domain (as used in eq(1) above) and applied to the time domain data $x_t$. Where filtering is performed in the time domain the time domain data may be delayed so that the filtering is applied to the time domain data from which it was derived, or (as the calculations can be relatively time-consuming), the filtering may be applied to the current time domain data (thus using coefficients which are slightly delayed relative to the data)

In some real-time applications, such as a listening aid, low latency is desirable. In this case, the filtering may be performed in the time domain using eq(1). The filter coefficients w are updated by using eq(25) to design the filter coefficients asynchronously in the STFT domain. For example, if calculation of the filter coefficients can be performed, say, every second then the coefficients are around 1 second out of date. This presents no problem if the acoustic scene is reasonably static (the speakers do not move around much), so that the filter coefficients are appropriate for later samples. If low latency is not needed, the procedure can use an inverse STFT on eq(26).

Stereo Filtering

A stereo output signal can be created by selecting an appropriate pair of rows from $W_f'$ in eq(25). This leads to a more natural sounding output which still retains some of the spatial cues from the source. A listener who has not lost too much of their ability to spatially discriminate sounds can make use of these cues to further aid in discrimination against any residual interference.

Example Implementations

Figure 2:
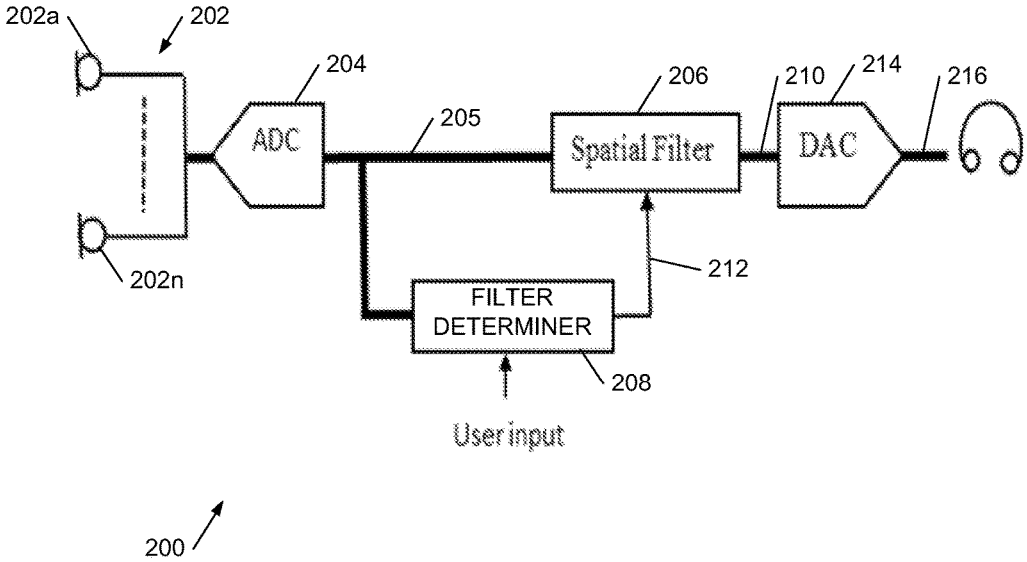
FIG. 2 shows the architecture of apparatus to improve audibility of an audio signal by blind source separation.

Referring to FIG. 2, this shows the architecture of apparatus 200 to improve the audibility of an audio signal by blind source separation, employing time-domain filtering to provide low latency. The apparatus comprises a microphone array 202 with microphones 202*a-n*, coupled to a multi-channel analogue-to-digital converter 204. This provides a digitised multi-channel audio output 205 to a spatial filter 206 which may be implemented as a multi-channel linear convolutional filter, and to a filter coefficient determiner 208. The filter coefficient determiner 208 determines coefficients of a demixing filter which are applied by spatial filter 206 to extract audio from one (or more) selected sources for a demixed audio output 210. The filter determiner 208 accepts optional user input, for example to select a source, and has an output 212 comprising demixing filter coefficients for the selected source. The demixed audio 210 is provided to a digital-to-analogue converter 214 which provides a time domain audio output 216, for example to headphones or the like, or for storage/further processing (for example speech recognition), communication (for example over a wired or wireless network such as a mobile phone network and/or the Internet), or other uses. In FIG. 2 the audio signal path is shown in bold.

In embodiments it is assumed that the acoustic scene is quasi-static and thus the filter coefficient determiner 208 and spatial filter 206 can operate in parallel. The latency is then determined by the main acoustic path (shown in bold), and depends upon the group delay of the filter coefficients, the latency of the spatial filter implementation, and the input/output transmission delays. Many different types of spatial filter may be used—for example one low latency filter implementation is to use a direct convolution; a more computationally efficient alternative is described in Gardener, W G (1995), "Efficient Convolution without Input-output Delay", *Journal of the Audio Engineering Society'*, 43 (3), 127-136.

The skilled person will recognise that the signal processing illustrated in the architecture of FIG. 2 may be implemented in many different ways. For example the filter designer, in preferred embodiments with a user interface, and/or spatial filter and/or DAC 214 may be implemented on a general purpose computing device such as a mobile phone, tablet, laptop or personal computer. In embodiments the microphone array and ADC 204 may comprise part of such a general purpose computing device. Alternatively some or all of the architecture of FIG. 2 may be implemented on a dedicated device such as dedicated hardware (for example an ASIC), and/or using a digital signal processor (DSP). A dedicated approach may reduce the latency on the main acoustic path which is otherwise associated with input/output to/from a general purpose computing device, but this may be traded against the convenience of use of a general purpose device.

Figure 3A:
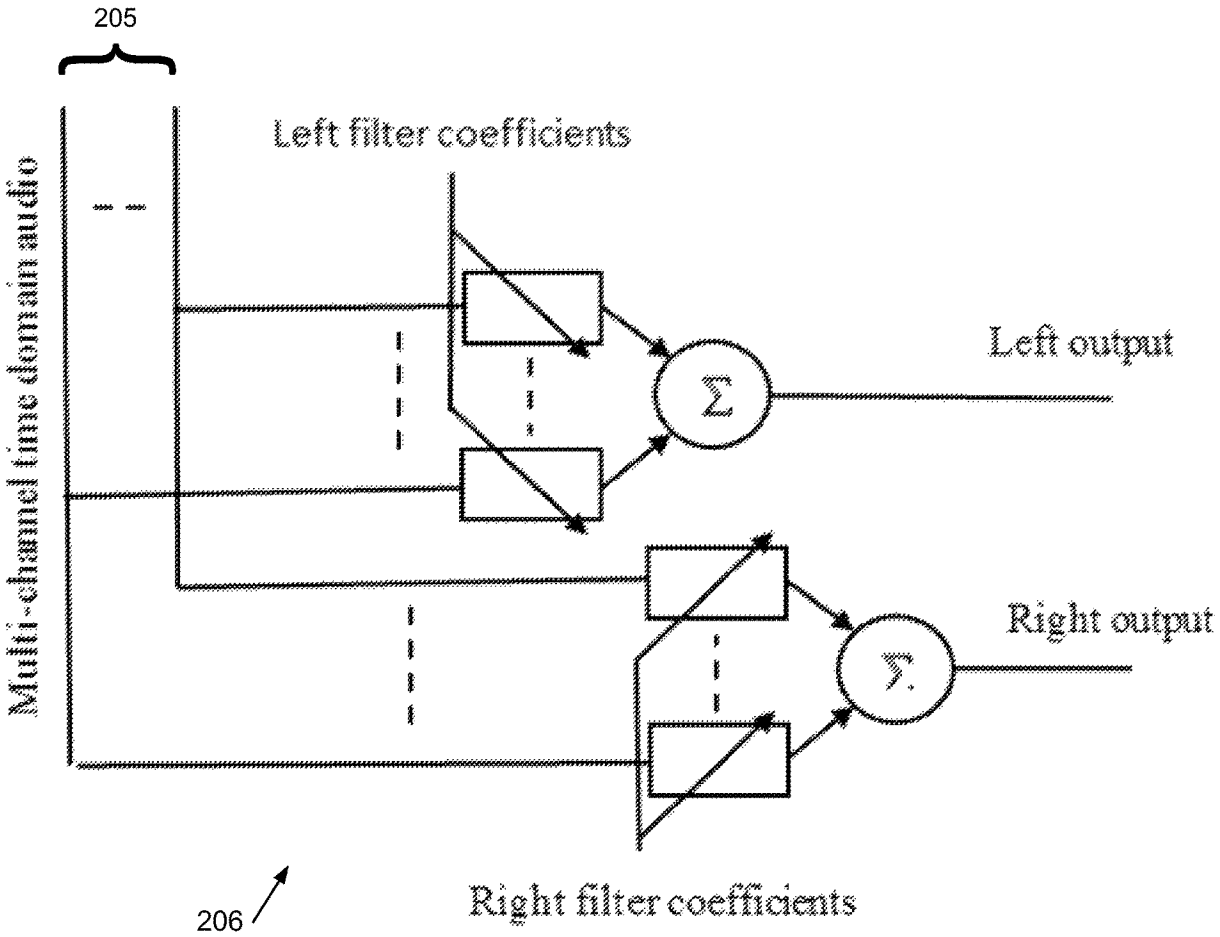
FIGS. 3*a* and 3*b* show, respectively, an example spatial filter for the apparatus of FIG. 2, and an STFT (short time fourier transform) implementation of time-frequency/frequency-time domain conversions for the system of FIG. 2.

An example spatial filter 206 for the apparatus of FIG. 2 is shown in FIG. 3*a*. The illustrated example shows a multi-channel linear discrete convolution filter in which the output is the sum of the audio input channels convolved with their respective filter co-efficients, as described in eq(1)

above. In embodiments a multi-channel output such as a stereo output is provided. For a stereo output either the spatial filter output may be copied to all the output channels or more preferably, as shown in FIG. 3*a*, a separate spatial filter is provided for each output channel. This latter approach is advantageous as it can approximate the source as heard by each ear (since the microphones are spaced apart from one another). This can lead to a more natural sounding output which still retains some spatial cues from the source. Thus a listener who has not lost too much of their ability to spatially discriminate sounds can employ those cues to further aid in discrimination against any residual interference.

Figure 3B:
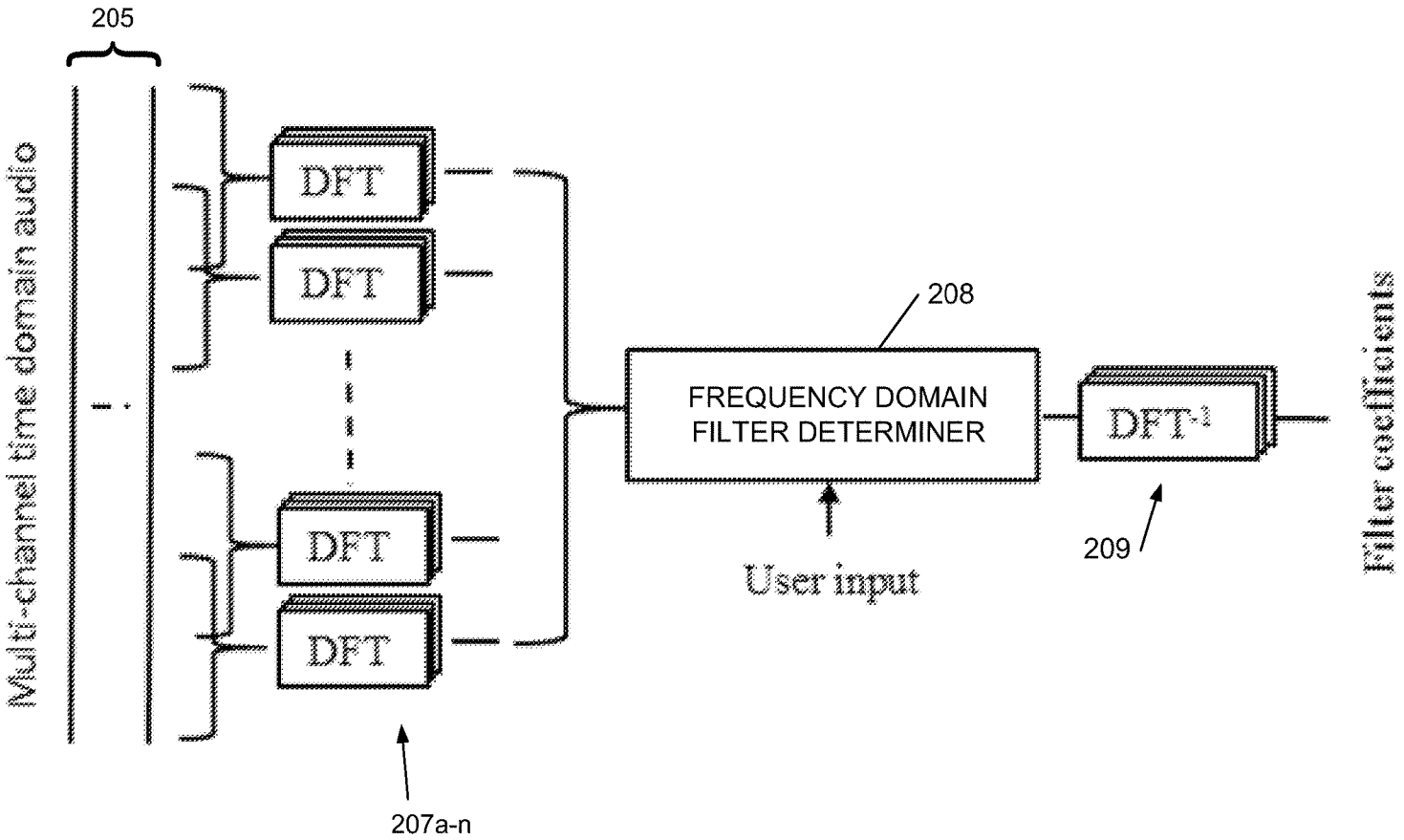

FIG. 3*b* shows time-frequency and frequency-time domain conversions (not shown in FIG. 2) for the frequency domain filter coefficient determiner 208 of FIG. 2. In embodiments each audio channel may be provided with an STFT (Short Time Fourier Transform) module 207*a-n* each configured to perform a succession of overlapping discrete Fourier transforms on an audio channel to generate a time sequence of spectra. Transformation of filter coefficients back into the time domain may be performed by a set of inverse discrete Fourier transforms 209.

The Discrete Fourier Transform (DFT) is a method of transforming a block of data between a time domain representation and a frequency domain representation. The STFT is an invertible method where overlapping time domain frames are transformed using the DFT to a time-frequency domain. The STFT is used to apply the filtering in the time-frequency domain; in embodiments when processing each audio channel, each channel in a frame is transformed independently using a DFT. Optionally the spatial filtering could also be applied in the time-frequency domain, but this incurs a processing latency and thus more preferably the filter coefficients are determined in the time-frequency domain and then inverse transformed back into the time domain. The time domain convolution maps to frequency domain multiplication.

Figure 4:
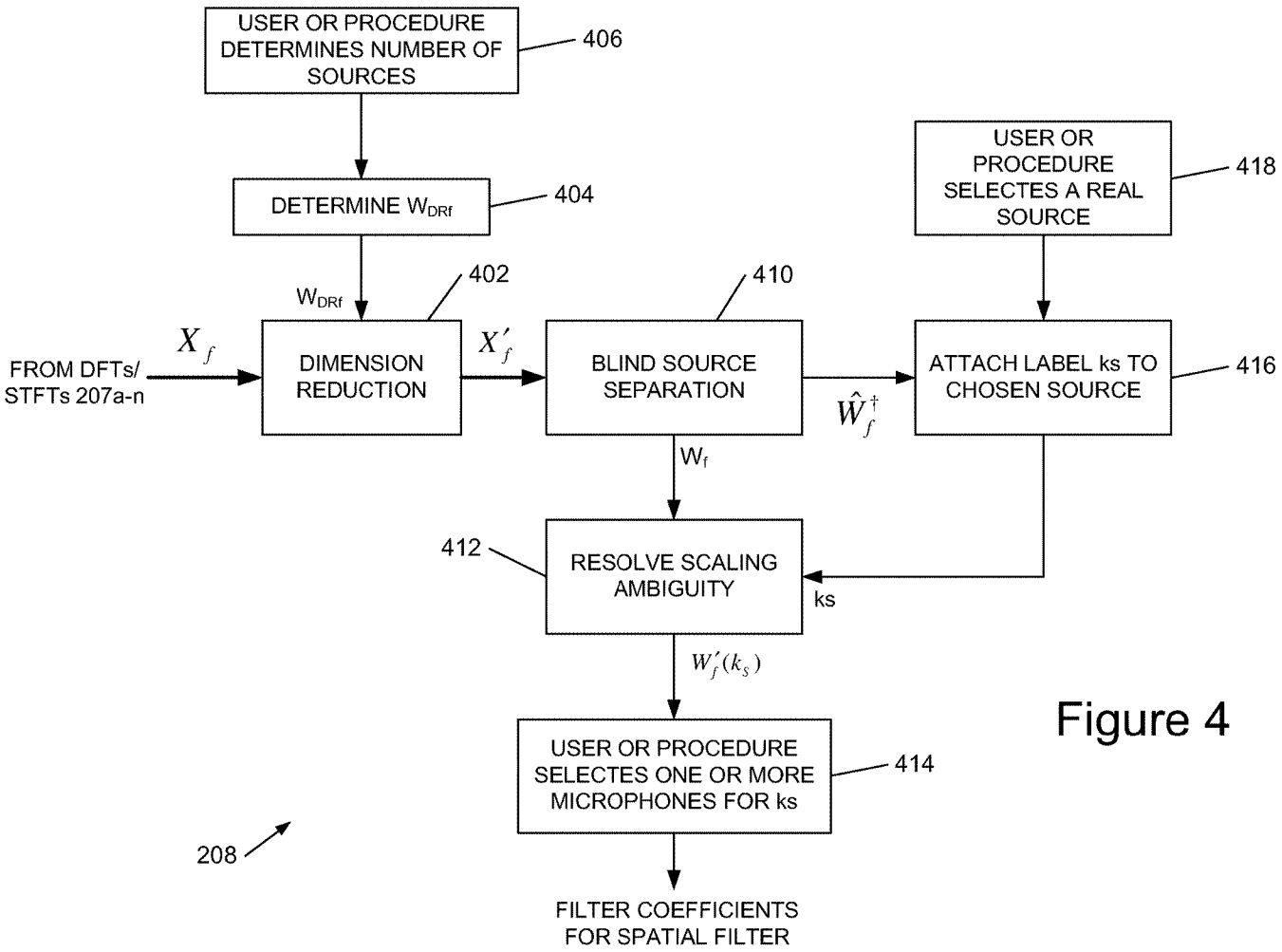
FIG. 4 shows modules of a frequency domain, filter-determining system for the apparatus of FIG. 2.

Referring now to FIG. 4, this shows modules of a preferred implementation of a frequency domain filter coefficient determiner 208 for use in embodiments of the invention. The modules of FIG. 4 operate according to the procedure as previously described. Thus the filter coefficient determination system receives digitised audio data from the multiple audio channels in a time-frequency representation, from the STFT modules 207*a-n* of FIG. 3*b*, defining the previously described observation matrix $X_f$. This is provided to an optional dimension reduction module 402 which reduces the effective number of audio channels according to a dimension reduction matrix $W_{DRf}$. The dimension reduction matrix, which in embodiments has fewer columns than rows, is determined (module 404) either in response to user input defining the number of sources to demix or in response to a determination by the system of the number of sources to demix, step 406. The procedure may determine the number of sources based upon prior knowledge or, for example, on some heuristic measure of the output or, say, based on user feedback on the quality of demixed output. In a simple implementation the dimension reduction matrix may simply discard some of the audio input channels but in other approaches the input channels can be mapped to a reduced number of channels, for example using PCA as previously outlined. The complete or reduced set of audio channels is provided to a blind source separation module 410 which implements a procedure as previously described to perform joint NMF-ICA source separation.

The blind source separation module 410 provides a set of demixing matrices as an output, defining frequency domain filter coefficients $W_f$. In embodiments these are provided to module 412 which removes the scaling ambiguity as previously described, providing filter coefficients for a source k at all the microphones (or reduced set of microphones). The user or the procedure then selects one or more of these microphones (by selecting data from one or more rows of $W_f(k)$), which are then output for use by the spatial filter after conversion back into the time domain.

In embodiments a source selection module 416 operates on a pseudo inverse of the demixing matrix, using the microphone phase responses to choose a source $k_s$. The source may be selected 418 either by the user, for example the user indicating a direction of the desired source, or by the procedure, for example based on a priori knowledge of the source direction.

Figure 5:
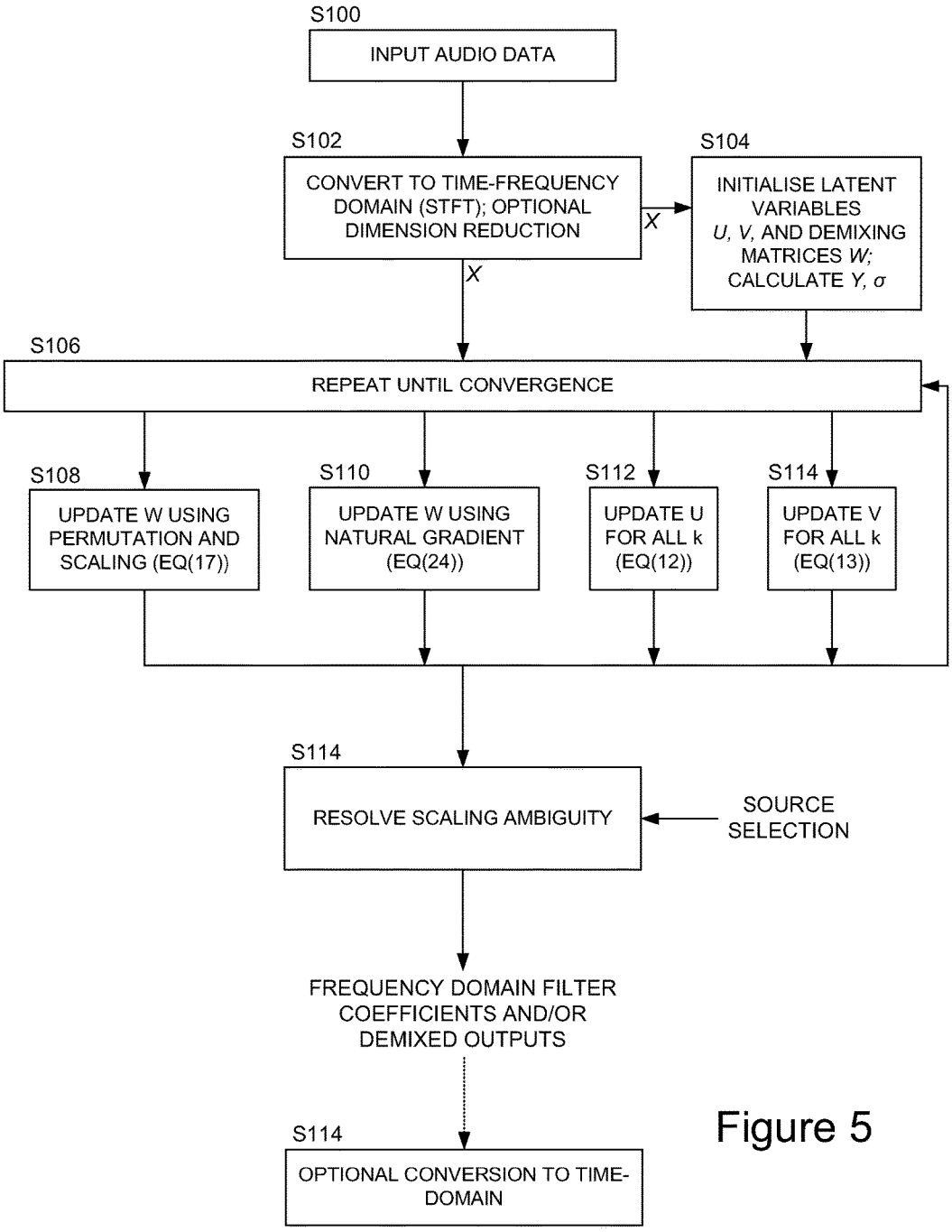
FIG. 5 shows a flow diagram of a procedure for blind source separation according to an embodiment of the invention.

FIG. 5 shows a flow diagram of a procedure for blind source separation according to an embodiment of the invention; this procedure may be used to implement the blind source separation module 410 and dimension reduction 402 of FIG. 4. Thus at step S100 the procedure inputs audio data and then converts this to the time-frequency domain, optionally reducing the number of audio channels (S102). The procedure also initialises latent variables U, V and the demixing matrices W, for example randomly or as previously outlined, and then calculates initial values for Y and $\sigma$. The procedure then repeats a number of update steps until convergence (S106); the convergence criterion may be a fixed number of iterations.

Update step S108 replaces W with a permuted and scaled version by calculating $Q_f$ then $\Lambda$ (eq19 above), then $P_f$(eq20), using this to update W (eq17). Update step S110 steps up the slope of W, performing a gradient search according to eq24. In an alternative approach step S110 may recalculate the NMF model rather than updating the model. Update steps S112, S114, update the latent variables U, V using, for example, equations 12 and 13 or the maximum likelihood alternatives described above.

Once convergence has been achieved preferably the procedure resolves scaling ambiguity (S114; implemented in module 412 of FIG. 4), and optionally converts the filter coefficients back to the time domain (S114).

Figure 6:
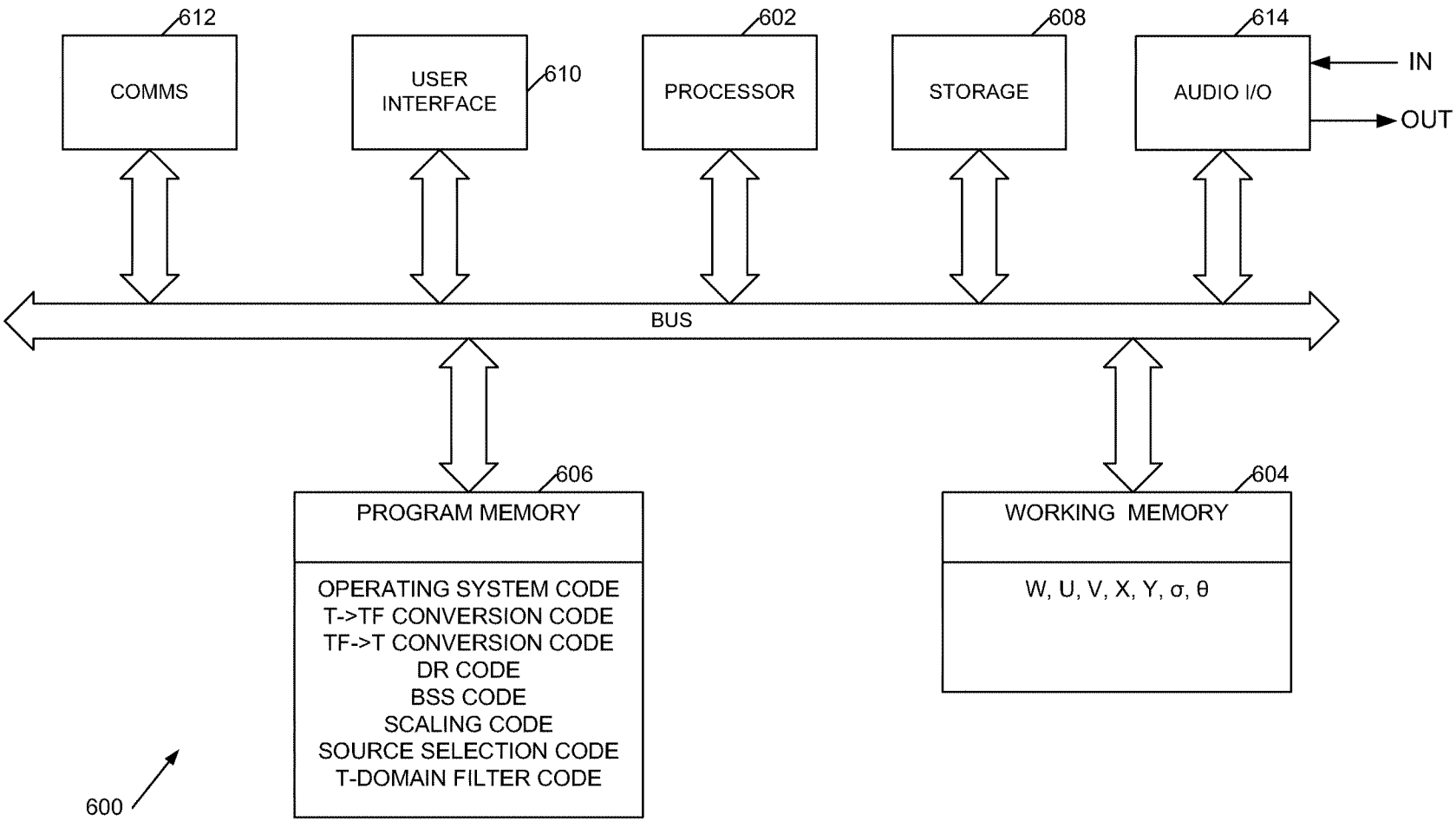
FIG. 6 shows a general purpose computing system programmed to implement the procedure of FIG. 5.

FIG. 6 shows an example of a general purpose computing system 600 programmed to implement a system as described above to improve audibility of an audio signal by blind source separation according to an embodiment of the invention. Thus the computing system comprises a processor 602, coupled to working memory 604, program memory 606, and to storage 608, such as a hard disk. Program memory 606 comprises code to implement embodiments of the invention, for example operating system code, time to frequency domain conversion code, frequency to time domain conversion code, dimension reduction code, blind source separation code, scaling code, source selection code, and spatial (time domain) filter code. Working memory 604/storage 608 stores data for the above-described variables W, U, V, X, Y, $\sigma$, and $\theta$. Processor 602 is also coupled to a user interface 612, to a network/communications interface 612, and to an (analogue or digital) audio data input/output module 614. The skilled person will recognise that audio module 614 is optional since the audio data may alternatively be obtained, for example, via network/communications interface 612 or from storage 608.

Although in some preferred implementations the above described techniques are applied to audio comprising speech, the techniques are not limited to such applications and can be applied to other acoustic source separation problems, for example processing seismic data. Often a selected source comprises a human speaker to provide a listening aid or to assist teleconferencing, machine hearing or speech recognition, or other in applications such as selectively capturing speech from a driver or passenger in a vehicle for a vehicle phone. In some applications, however, embodiments of the techniques may be employed to identify a noise-like source (for example a source with the most noise-like characteristics may be selected), and this selected source may then be employed for active noise cancellation.

In principle the techniques we describe may be employed outside the audio/acoustic domain, for example to mixed-source electrical signal data such as data from sensing apparatus or instrumentation such as laboratory or medical apparatus. Examples include EEG (electroencephalography) data, and mixed source spectral data from a spectrum analyser such as an optical spectrum analyser, mass spectrum analyser or the like.

No doubt many other effective alternatives will occur to the skilled person. It will be understood that the invention is not limited to the described embodiments and encompasses modifications apparent to those skilled in the art lying within the spirit and scope of the claims appended hereto.

What is claimed is:

1. A method of processing acoustic data representing audio from a plurality of different acoustic sources mixed together to extract the audio from an individual one of the acoustic sources so that it can be listened to separately, the method comprising performing blind source separation by:

inputting acoustic data from a plurality of acoustic sensors, said acoustic data comprising acoustic signals combined from said plurality of acoustic sources;

converting said input acoustic data to combined source time-frequency domain data representing said acoustic signals combined from said plurality of acoustic sources, wherein said time-frequency domain data is represented by an observation matrix $X_f$ for each of a plurality of frequencies $f$;

performing an independent component analysis (ICA) on said observation matrix $X_f$ to determine a demixing matrix $W_f$ for each said frequency such that an estimate $Y_f$ of the acoustic signals from said plurality of acoustic sources at said frequencies $f$ is determined by $X_f W_f$;

wherein said ICA is performed based on an estimation of an individual source spectrogram of each individual said acoustic source; and wherein said estimation of said individual source spectrogram of each individual said acoustic source is determined from a model of said individual acoustic source, the model representing individual source time-frequency variations in a signal output of said individual acoustic source;

using said demixing matrix $W_f$ to process said acoustic data comprising acoustic signals combined from said plurality of acoustic sources and demix individual acoustic data for an individual one of said plurality of acoustic sources; and providing the acoustic data for the individual one of said plurality of acoustic sources to an output device for transmission to a user.

2. A method as claimed in claim 1 comprising iteratively improving said ICA and said model by performing said ICA to estimate said acoustic signals from said plurality of acoustic sources, then updating said model using said estimated acoustic signals to provide an updated estimation of said individual source spectrogram of each individual said acoustic source, then updating said ICA using said updated estimations of said individual source spectrograms.

3. A method as claimed in claim 2 wherein updating said ICA comprises determining a permutation of elements of said demixing matrix $W_f$ over said acoustic sources prior to determining said updated estimations of said individual source spectrograms for said plurality of acoustic sources.

4. A method as claimed in claim 2 wherein said updating of said ICA comprises adjusting said demixing matrix $W_f$ by a value dependent upon a gradient of said demixing matrix, wherein said gradient of said demixing matrix is dependent upon both said estimate $Y_f$ of said acoustic signals from said plurality of acoustic sources and said estimation of said individual source spectrogram of each individual said acoustic source.

5. A method as claimed in claim 1 wherein said model for each acoustic source comprises a time-frequency dependent non-negative matrix factorisation (NMF) model.

6. A method as claimed in claim 5 wherein said NMF model comprises, for each of said plurality of acoustic sources, a spectral dictionary and set of dictionary activations; and wherein the method further comprises updating said spectral dictionary and said set of dictionary activations for the acoustic sources responsive to said estimate of the acoustic signals from the sources ($Y_f$).

7. A method as claimed in claim 6 wherein said spectral dictionary and said set of dictionary activations are jointly optimised with the demixing matrix $W_f$ for each said frequency.

8. A method as claimed in claim 7 wherein said joint optimisation comprises performing, jointly, the following operations:

$Y_f \leftarrow X_f W_f$ for all $f$ after updating $W_f$; and $\sigma_k^{\cdot\lambda} \leftarrow V_k^T U_k$ for all k after updating U or V where $\leftarrow$ denotes updating, $U_k$ and $V_k$ denote dictionaries and activations of said NMF model for each of said acoustic sources k, $\sigma_k$ denotes said estimation of the spectrogram of acoustic source k, and $\lambda$ is a parameter greater than zero.

9. A method as claimed in claim 8 wherein $\lambda=1$.

10. A method as claimed in 1 further comprising preprocessing said acoustic data to reduce a number of said acoustic signals from said plurality of acoustic sensors to a reduced number of acoustic signals which is less than a number of said acoustic sensors, wherein said reduced number of acoustic signals is equal to a number of said plurality of said acoustic sources.

11. A method as claimed in claim 1 further comprising compensating for a scaling ambiguity in $W_f$ using said individual acoustic data as predicted to be received at one or more of said acoustic sensors.

12. A method as claimed in claim 1 wherein said converting of said acoustic data to the time-frequency domain is performed blockwise for successive blocks of time series acoustic data, the method further comprising ensuring that said individual acoustic data for an individual one of said plurality of acoustic sources represents the same individual one of said plurality of acoustic sources from one of said blocks to a next of said blocks to at least partially remove a source permutation ambiguity.

13. A method as claimed in claim 1 comprising using said demixing matrix $W_f$ in a time domain to process said acoustic data comprising acoustic signals combined from a plurality of acoustic sources and demix individual acoustic data for an individual one of said plurality of acoustic sources.

14. A non-transitory data carrier carrying processor control code to, when running, implement the method of claim 1.

15. A method of processing acoustic data representing audio from a plurality of different acoustic sources mixed together to extract the audio from an individual one of the acoustic sources so that it can be listened to separately, the method comprising performing blind source separation by:

capturing the acoustic data representing audio from the plurality of acoustic sources at a plurality of microphones;

processing the captured acoustic data to provide a set of observation matrices, said set of observation matrices representing observations of acoustic signals combined from said plurality of acoustic sources, wherein said set of observation matrices comprises a plurality of observation matrices, wherein each observation matrix is denoted $X_f$ and comprises data in a time-frequency domain for one of a plurality of frequencies $f$;

wherein acoustic data for one of said plurality of acoustic sources and at one of said plurality of frequencies, demixed from said acoustic signals combined from said plurality of acoustic sources, is denoted $Y_f$, where $Y_f$ comprises data in said time-frequency domain, and processing said set of observation matrices using a demixing matrix $W_f$ for each of said plurality of frequencies to determine an estimate of said acoustic data, denoted $Y_f$, demixed from said acoustic signals combined from said plurality of acoustic sources;

wherein said processing comprises iteratively updating $Y_f$ from $X_f$ $W_f$; and wherein said processing is performed based on a probability distribution $p(Y_{tkf}; \sigma_{tkf})$ for Y dependent upon $$\frac{1}{\sigma_{tkf}^2} e^{-\frac{|Y_{tkf}|^1}{\sigma_{tkf}^2}}$$

where t indexes time intervals and k indexes said acoustic sources or acoustic sensors sensing said acoustic sources; and wherein $\sigma_{tkf}$ are variances inferred from a non-negative matrix factorisation (NMF) model where $$\sigma_{tkf}^{\lambda} = \sum_{l} V_{ltk} U_{lfk}$$

where l indexes non-negative components of said NMF model, U and V are latent variables of said NMF model, and $\lambda$ is a parameter greater than zero; and providing the acoustic data for the individual one of said plurality of acoustic sources to an output device for transmission to a user.

16. A method as claimed in claim 15 wherein said iterative updating comprises updating $W_f$ given $U_{lfk}$ and $V_{ltk}$, updating $U_{lfk}$ given $V_{ltk}$ and $W_f$, and updating $V_{ltk}$ given $W_f$ and $U_{lfk}$.

17. A method as claimed in claim 16 wherein said updating of $W_f$ includes determining one or both of a permuted version of $W_f$ and a scaled version of $W_f$.

18. Apparatus to improve audibility of an audio signal by blind source separation, the apparatus comprising:

a set of microphones, each of the set of microphones having a known geometry, to receive signals from a plurality of audio sources disposed around the microphones; and an audio signal processor coupled to said microphones, and configured to providing a demixed audio signal output;

the audio signal processor comprising:

at least one analog-to-digital converter to digitise said signals received by said microphones to provide digital time-domain signals; and a digital filter to filter said digital time-domain signals in the time domain in accordance with a set of filter coefficients to provide said demixed audio signal output;

the audio signal processor further comprising:

a time-to-frequency domain converter to divide said digital time-domain signals into time segments and to convert said digital time-domain signals in said time segments into the frequency domain to generate time-frequency domain data;

a blind source separation module, to perform audio signal demixing on said time-frequency domain data to determine a demixing matrix for at least one of said audio sources, wherein said set of filter coefficients is determined by said demixing matrix and is determined asynchronously in said time-frequency domain; and wherein said audio signal processor is further configured to:

process said demixing matrix, in view of a frequency and phase response of each microphone, determined from the known geometry of the microphone, to select one or more said audio sources responsive to a phase correlation determined from said demixing matrix.

19. Apparatus as claimed in claim 18 wherein said audio signal processor is further configured to reduce a number of audio channels from said microphones prior to said audio signal demixing, and to resolve a scaling ambiguity in said demixing matrix.

20. Apparatus as claimed in claim 19 wherein said blind source separation module is configured to perform joint independent component analysis (ICA) and non-negative matrix factorisation (NMF) to perform said audio signal demixing.

* * * * *